United States Patent [19]

Egger

[11] 4,349,039

[45] Sep. 14, 1982

[54] HOME ROOF GUTTER SWEEP

[76] Inventor: Robert S. Egger, 4012 - 91st Ave. SE., Mercer Island, Wash. 98040

[21] Appl. No.: 135,250

[22] Filed: Mar. 31, 1980

Related U.S. Application Data

[63] Continuation-in-part of Ser. No. 910,658, May 30, 1978, abandoned.

[51] Int. Cl.[3] ..... B08B 3/02; B08B 9/00

[52] U.S. Cl. ..... 134/167 C; 134/172; 239/280; 239/447; 239/578

[58] Field of Search ..... 239/280, 280.5, 281, 239/446–447, 532, 578; 134/167 R, 167 C, 168 R, 168 C, 172, 177–178, 180, 198; 15/92; 52/16

[56] References Cited

U.S. PATENT DOCUMENTS

| | | | |
|---|---|---|---|
| 979,335 | 12/1910 | Reid | 239/447 X |
| 1,026,608 | 5/1912 | Schorn | 239/446 X |
| 2,038,803 | 4/1936 | Olson | 134/177 X |
| 2,710,616 | 6/1955 | Tydings | 134/167 R |
| 3,751,749 | 8/1973 | Wilson | 15/92 |
| 3,908,910 | 9/1975 | Detwiler | 239/280 |
| 4,183,368 | 1/1980 | Husted | 134/198 X |

*Primary Examiner*—Robert L. Bleutge

[57] ABSTRACT

There is disclosed a device mounted for traveling movement on the edge of a rain gutter to clean it. The frame of this device may be stamped from a single sheet of metal or molded as a single piece from a plastic and has a vertical portion, to which is rigidly secured, the fixed tubular part of a rotary valve. Support rollers are carried on horizontal axes in turn carried by a vertical portion of the frame and these support rollers support the device for travel on the outer edge of a rain gutter. The frame continues to a U-shaped portion providing a horizontal frame portion. Guide rollers are mounted on vertical axes carried by the horizontal frame portion. These guide rollers are individually adjustable and support the device against lateral tipping. The fixed tubular valve part may have one nozzle or may have two nozzles connected therewith directing fluid in opposite directions in a rain gutter. In one version a rotary valve part is mounted in the fixed valve part and is connected with a conduit in turn connected with a source of fluid under pressure. The rotary valve part is movable to connect the source of fluid alternately with one or the other nozzle. The conduit to the source of fluid is rigid and also functions as a mechanism to be hand engaged to cause the device to travel and also as a lever for operating the rotary valve parts.

15 Claims, 26 Drawing Figures

FIG. 1
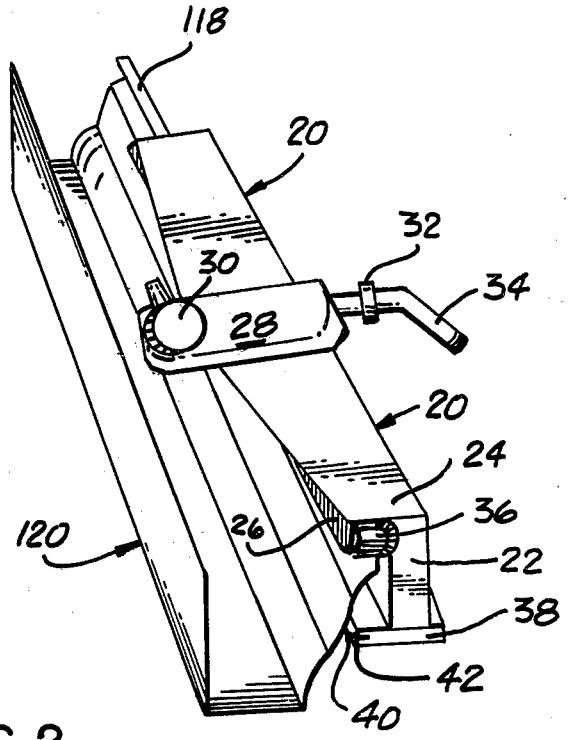
FIG. 2
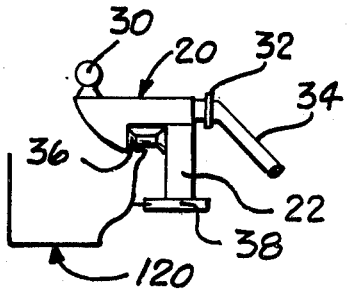
FIG. 3
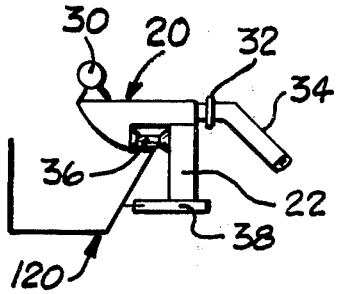
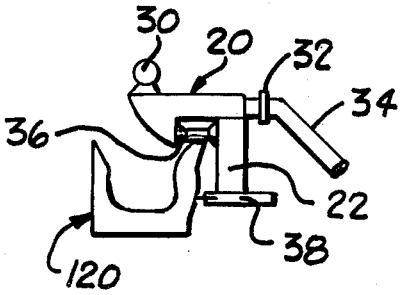
FIG. 4

FIG. 9
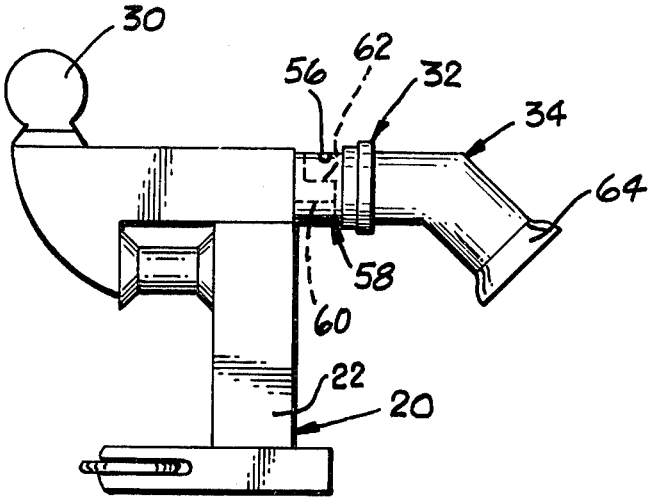
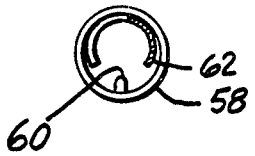
FIG. 10
FIG. 11
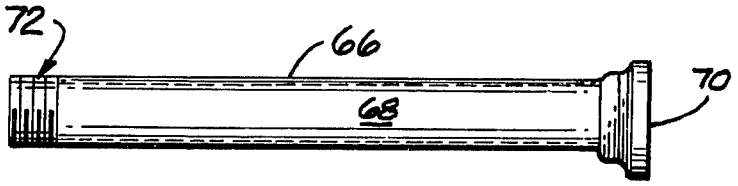
FIG. 12
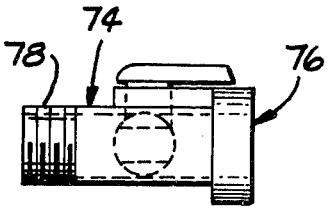
FIG. 13
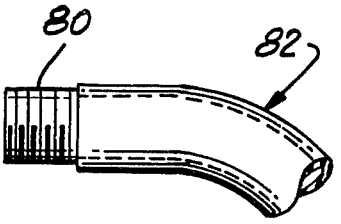

HOME ROOF GUTTER SWEEP

CROSS REFERENCE TO RELATED APPLICATIONS

This application is a continuation-in-part of my copending application Ser. No. 910,658, filed May 30, 1978, now abandoned, and entitled HOME ROOF GUTTER SWEEP. The only pertinent prior art known to applicant is cited therein and consists of the following patents issued by the U.S. Patent and Trademark Office:

| PATENTEE | U.S. PAT. NO. |
|---|---|
| A. O. TYDINGS | 2,710,616 |
| JIMMIE L. WILSON | 3,751,749 |
| S. OLSON | 2,038,803 |

BRIEF DESCRIPTION OF THE INVENTION

This invention is directed to the use of a high pressure water nozzle, mounted on a carrier frame that will be guided along the outside edge of a gutter by a person holding the rigid hollow handle which also carries water to the carriage and nozzle. The high pressure nozzle is mounted on the carriage in a position that centers the nozzle on most standard size gutters allowing a forceful stream of water to sweep and flush out debris from the inside of a gutter.

In one version the water, which is supplied by a standard garden hose, is controlled with an on-off pressure valve at the base of the handle where it is held and controlled by the operator.

The high pressure nozzle is mounted on a swivel, allowing the water to be directed either to the right or to the left of the carriage.

The carriage is allowed to roll along the upper outside edge of the rain gutter with the use of spool rollers which also act as a stabilizing guide to keep the high pressure nozzle pointed downward and to the approximate center of the inside of the gutter.

The carriage has a base attached to it which adjusts to the correct distance to the lower outside edge of the gutter, forcing the carriage to remain stable, upright and level at all times. The base is also equipped with rollers that meet the lower outside edge of the gutter and allows smooth rolling and easy guidance of the apparatus.

The hollow water carrier handle will be equipped with an optional 45° or 90° swivel locking elbow joint which attaches to the carriage, and will allow the operator to stand at an angle other than directly under the apparatus while operating it, and additionally, the locking mechanism will allow the carriage unit to be positioned on its either end so as to allow the high pressure nozzle to point down into and flush out the downspouts, by merely raising the hand held end of the handle a few inches above normal operating position.

In another version the frame of my invention is preferably formed or stamped from a single sheet of metal or molded from a plastic material into a single piece. Vertical, horizontal, and lateral as used herein relate to positions of the parts when in use. Such frame is provided with a vertical portion. This vertical portion is rigidly secured to the stationary tubular part of a rotary valve mechanism. This valve part has its discharge through two nozzles, carried by the valve part, and which nozzles point in opposite directions. Spaced apart supporting roller means are connected with this vertical portion and support the frame to travel on the outer edge of a rain gutter.

The single sheet of material (metal or plastic) then bends to provide a support for spaced guide roll means. The spaced guide roll means rotate about vertical axes and this may be accomplished by continuing the sheet from the vertical portion through a substantially U-shaped bend terminating in a horizontal portion to support the vertical axes of the guide roller means. The said shape will permit the support roller means to ride on the top of the outside rail of a rain gutter and the guide roller means to engage the outer mid-portion of the same outside gutter rail.

A fixed rotary valve part is connected with a conduit which, in turn, is connected with a source of fluid under pressure. The rotary valve part is seated in the fixed tubular valve part and ports are provided in the rotary valve part so that the rotary valve part may be turned to connect the source of fluid with one of the nozzles or with the other nozzle. The conduit to the source of fluid pressure is the lever for moving the rotary valve part. This conduit is rigid and is long enough so that it may be hand engaged by a person on the ground and used as means to propel the device along the rain gutter as desired.

The various advantages, functions, and uses of my invention previously mentioned will become explicit and implicit as the description of my invention proceeds in connection with the detailed description of the drawings and wherein like reference numerals related to like parts.

THE DRAWINGS

FIGS. 1–13 are of one version of the invention wherein FIG. 1 is a perspective view of a gutter and the apparatus for moving along the gutter and for cleaning the gutter;

FIG. 2 is a side-elevational view of a gutter having a curved front and the apparatus mounted on the gutter;

FIG. 3 is a side-elevational view of a gutter having a slanted front and the apparatus mounted on the gutter;

FIG. 4 is a side-elevational view of a wooden gutter having less dramatic curving in its front and the apparatus mounted on the gutter;

FIG. 5 is a top-plan view of the apparatus and illustrates the nozzle for directing fluid into the gutter;

FIG. 6 is a back-elevational-plan view of the apparatus and illustrates the nozzle for directing fluid into the gutter;

FIG. 7 is a side-elevational-plan view of the apparatus and illustrates the bottom plate for adjusting the apparatus to the side of a gutter;

FIG. 8 is a top view of the bottom plate for adjusting the apparatus to the gutter;

FIG. 9 is a side-elevational view of the apparatus and illustrates the coupling and elbow used to convey fluid through the apparatus and into the gutter;

FIG. 10 is a lateral-cross-sectional view of a coupling for connecting the tube and an apparatus for the tube conveying a fluid to the apparatus;

FIG. 11 is a side view of the tubing for conveying fluid to the apparatus;

FIG. 12 is a side view of the off-on and pressure valve that connects to the tube for controlling fluid to the apparatus;

FIG. 13 is a side view of a garden hose that conveys fluid to the apparatus and connects to the off-on and pressure valve.

FIGS. 14–26 are of another version of the invention wherein FIG. 14 is a side elevational view of my device, with parts broken away and showing by dot-and-dash lines other positions of the conduit lever connected to a source of fluid under pressure;

FIG. 15 is a view similar to FIG. 14 taken from the opposite side of the device;

FIG. 16 is an end elevational view and with parts of the conduit-lever means broken away;

FIG. 17 is a top plan view of the structure of FIG. 16;

FIG. 18 is a bottom plan view of the structure of FIG. 17;

FIG. 19 is a perspective view showing the device when in use on a rain gutter of a house;

FIG. 20 is a perspective view of the device and with a portion of the conduit-lever broken away;

FIG. 21 is a sectional view, on a larger scale, and taken substantially on broken line 21—21 of FIG. 18;

FIG. 22 is a view partially in section and partically in elevation and taken substantially on broken line 22—22 of FIG. 21 showing the valving mechanism in a neutral position;

FIG. 23 is a view similar to FIG. 22 showing the valving mechanism open to the right-hand nozzle in said figure and closed to the left-hand nozzle in said figure;

FIG. 24 is a view similar to FIG. 22 but showing the valving mechanism open to the left-hand nozzle in said FIG. 24 and closed to the right-hand nozzle in FIG. 24;

FIG. 25 is an enlarged, fragmentary, elevational view showing the device in use on a rain gutter and wherein the fluid is being sprayed to the left as respects said figure; and FIG. 26 is a view similar to FIG. 25 except showing the fluid being sprayed to the right as it affects the showing in FIG. 26.

THE SPECIFIC DESCRIPTION OF THE INVENTION

Figure 5:
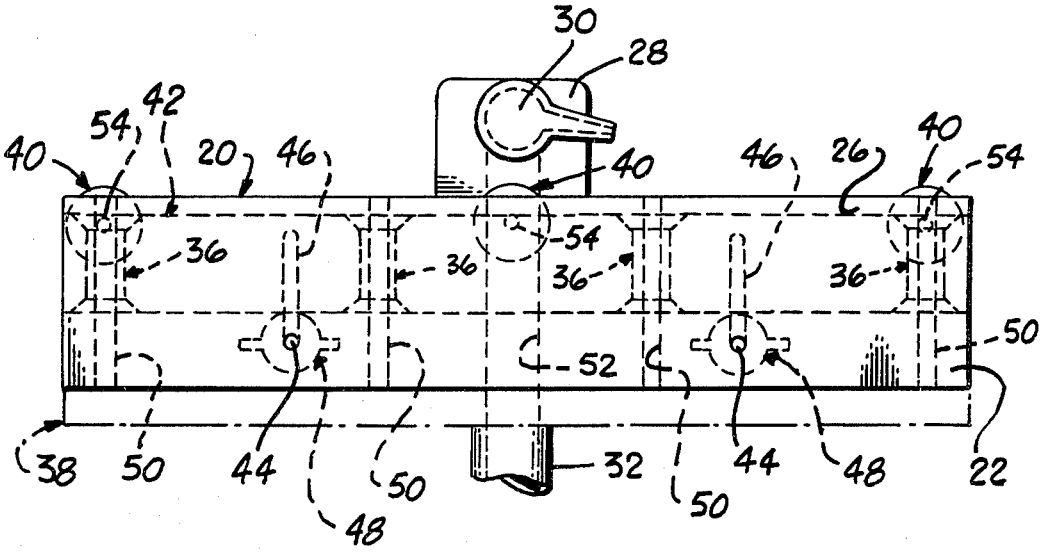

FIGS. 1–13 are for one version of the invention and in FIG. 1 there is illustrated the gutter cleaner 20. The gutter cleaner 20 comprises a carriage frame 22 having a top plate 24 and support flange 26. On the top center of the top plate 24 is a hollow fluid carrier 28 upon which is mounted a high pressure swivel nozzle 30, and to which is connected a hollow coupling 32 and elbow 34. Between the support flange 26 and the carriage frame 22 are four (4) evenly spaced roller spools 36 which have hollow centers and are positioned by pins 50 imbedded in the carriage frame 22 and extending through the hollow center of the roller spools 36 and anchored in the support flange 26. The roller spools 36 allow the gutter cleaner 20 to move and be guided along the upper outside edge 118 of a gutter 120. Attached to the lower bottom of the carriage frame 22 is an adjustable bottom plate 38 with three (3) evenly spaced guide rollers 40 fitted in indented space along the inside edge 42 of the bottom plate 38.

In FIGS. 2, 3 and 4 there is illustrated the adjusted positions of bottom plate 38 to the various irregular shapes of the lower outside edges of different types of gutters 120. It can be seen that the bottom plate 38 stabilizes the carrier frame 26 in an upright and level position, allowing the high pressure nozzle 30 to be positioned in the center of the gutter 120.

In FIG. 5 there is illustrated the gutter cleaner 20, the relative positions of, the hollow roller spools 36 to each other, the guide rollers 40 to each other, the adjusting pins 44 which are imbedding in the carriage frame 22, and pass through the center hollow of the spools 36 and are imbedded in the support flange 26 and carriage frame 22.

FIG. 5 also shows the guide rollers 40 which are evenly positioned in indented spaces along the inside edge 42 of the bottom plate 38. The guide rollers 40 are positioned with pins 54.

In FIG. 5 it is seen how the high pressure nozzle 30 is positioned on top of the hollowed fluid carrier 28 as well as the hollow fluid passage 52 which enters the hollow coupling 32.

Figure 6:
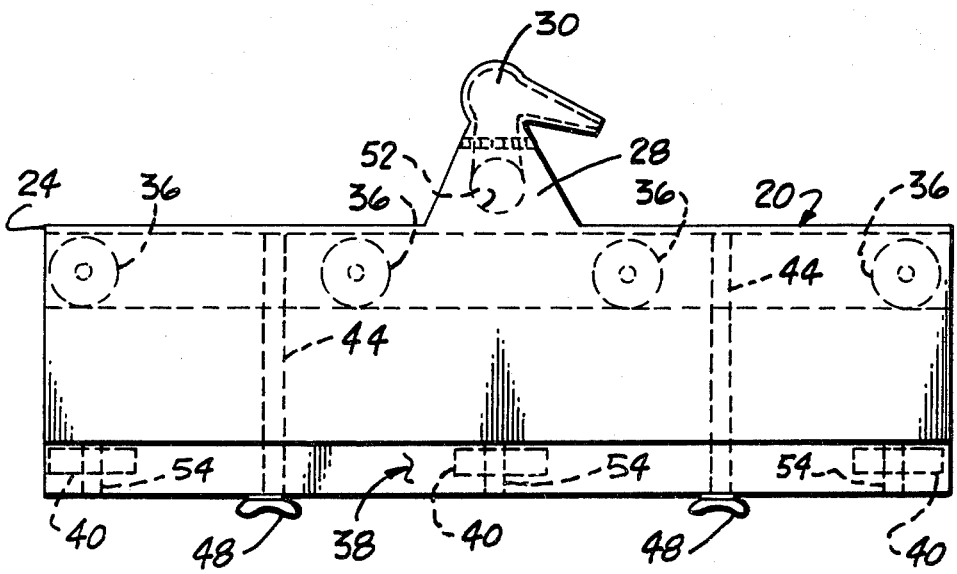

In FIG. 6 there is shown the gutter cleaner 20, the position of the high pressure nozzle 30 on the fluid carrier 28 with its hollow passage 52, and the top plate 24 in its position on top of the carriage frame 22. The roller spools 36 are shown in relation to their respective positions to one another and the top plate 24. FIG. 6 also illustrates the adjusting pins 44 clamping the bottom plate 38 to the bottom of the carrier frame 22 with butterfly nuts 48. In FIG. 6 the guide rollers 40 are seen positioned in the bottom plate 38 with pins 54.

Figure 7:
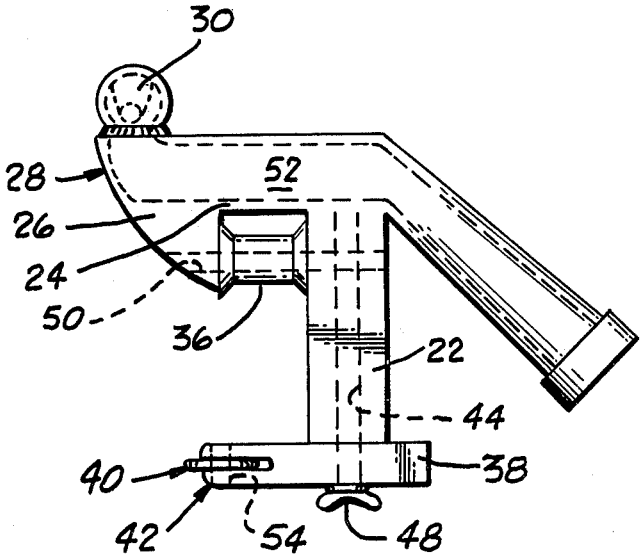

FIG. 7 illustrates the fluid passage 52 as it passes through the fluid carrier 28 in its position on top of the top plate 24 and as it supplies fluid to the high pressure nozzle 30. FIG. 7 also illustrates the position of the roller spools 36, their positioning pins 50 and their position between the support flange 26 and the carriage front 22. FIG. 7 also shows the bottom plate 38, clamped to the carriage frame 22 by the butterfly nuts 48 threaded on the adjusting pins 44. FIG. 7 also illustrates the position of the guide rollers 40 positioned by pins 54 in the indented space on the inside edge 42 of the bottom plate 38.

Figure 8:
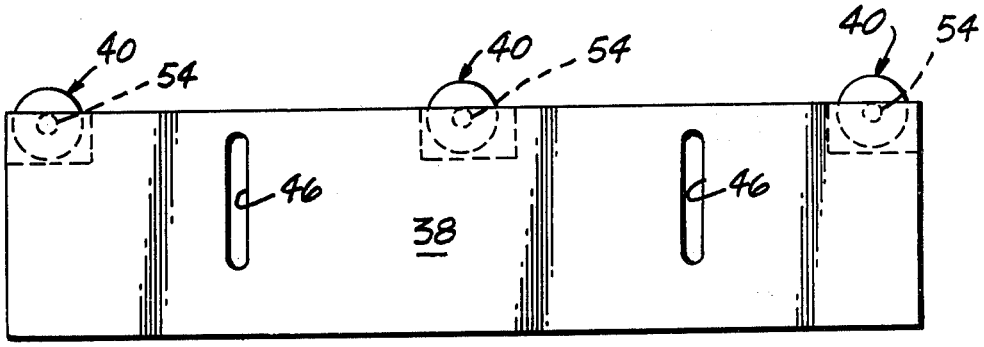
Figure 14:
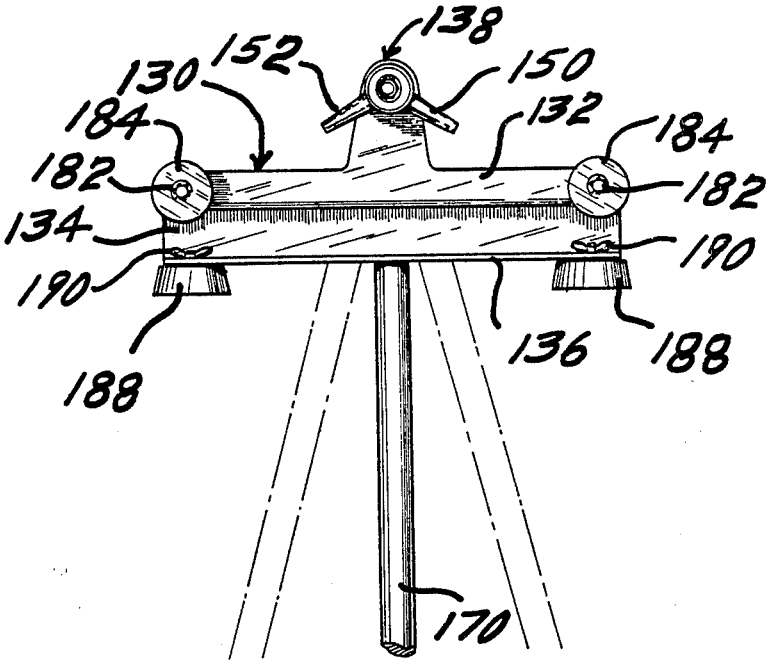
Figure 15:
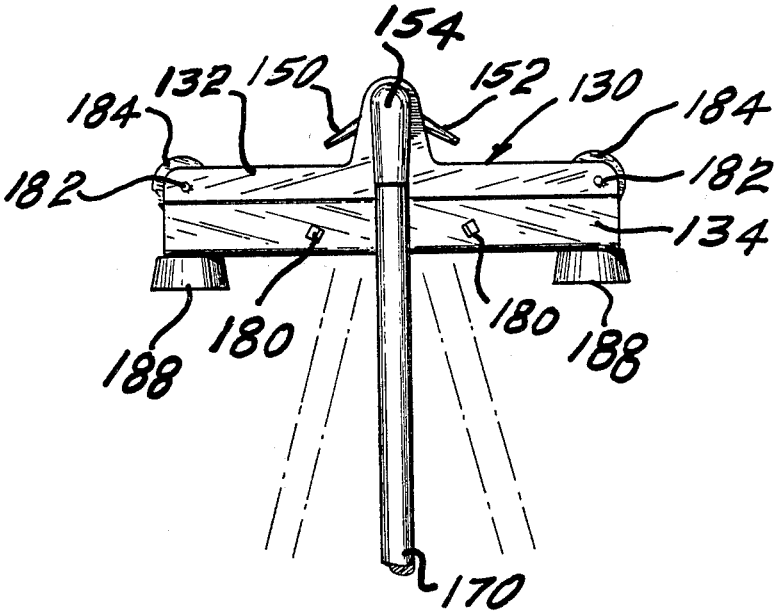

In FIG. 8 there is shown the bottom plate 38 and the location of the guide rollers 40 positioned by pins 54 within the indented space on the inside edge 42 of the bottom plate 38. FIG. 8 also illustrates the position of the adjusting grooves 46.

FIGS. 9 and 10 illustrate the couplings 56 and 58. FIGS. 9 and 10 illustrate how coupling 56 fits inside of coupling 58 which is attached to the gutter cleaner 20 in the fluid carrier 28. Coupling 58 has an obstruction 60 built into the inside bottom of the cylinder which prevents coupling 56 which has a cut away lower one third ($\frac{1}{3}$), from turning more than 45°. Coupling 56 has a protruding upper two thirds ($\frac{2}{3}$) cylinder 62 which fits inside and beyond the obstruction 60 and is locked from turning beyond a 45° turn when cylinder 62 comes into contact with obstruction 60. When coupling 56 is turned beyond 45° after it has been blocked, thus locked by obstruction 60, it causes the gutter cleaner 20 to stand on its other end, thus directing the high pressure nozzle 30 directly downward and allows fluid to be directed down and into a gutter down-spout which allows it to be flushed and cleaned.

FIG. 9 illustrates how female coupling 32 fits over male end of 45° elbow 34 and female coupling 64 is designed to accept the male end of the hollow tube shown in FIG. 11.

FIG. 11 illustrates a lateral view of the hollow tube 66 with its hollow fluid passage 68 as well as the female coupling 70 which accepts the male end of the off-on and pressure valve shown in FIG. 12. FIG. 11 also shows the male end 72 which is designed to fit into female coupling 64 as illustrated in FIG. 9. There may be from one (1) to eight (8) hollow tubes, each approximately 5 feet long, attached to one another which may extend between the gutter cleaner and the off-on and pressure valve to comprise a connected continuing hollow tube of varying lengths which will carry fluid into and through the gutter cleaner.

FIG. 12 illustrates an off-on and pressure valve 74. It is to be understood that FIG. 12 is commercially available and may be used to control the fluid into the hollow tube. In FIG. 12 it is shown that the valve 74 has a female coupling 76 and male end 78.

FIG. 13 illustrates the male end 80 of a garden hose 82 which is commercially available and attaches to the female coupling of the off-on pressure valve shown in FIG. 12.

Figure 16:
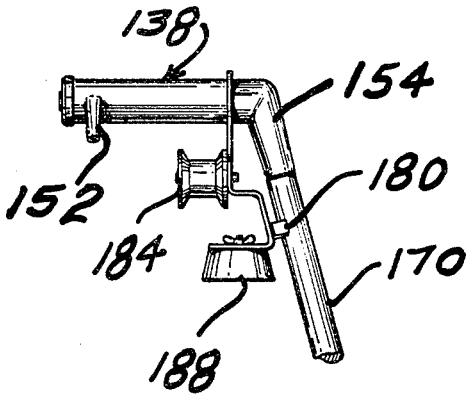
Figure 17:
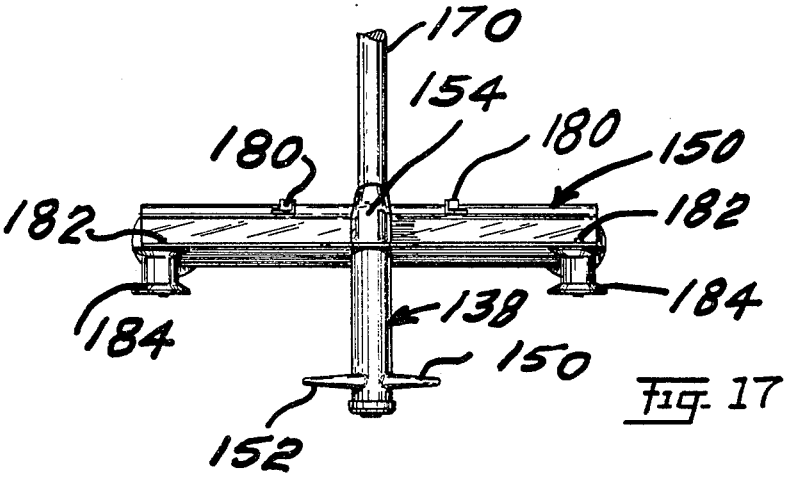
Figure 18:
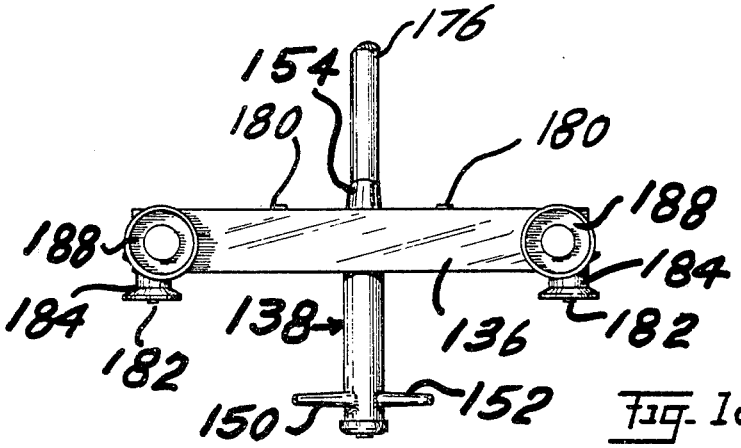

FIGS. 14–26 are of another version of the invention. The frame 130 (see FIG. 16) is preferably formed from a single sheet of metal or by a stamping process or molded from a plastic into a single piece. With reference to directions of the device when in use and to relative positions in the drawings, the frame 130 comprises a vertical portion 132 and a U-shaped portion 134 (turned 90° to that of a normal U). The U-shaped portion 134 terminates in a horizontal position 136.

The vertical position 132 rigidly supports the fixed tubular valve part indicated generally by 138. The valve part 138 (see FIG. 21) preferably comprises cylindrical part 140, cap 144, bolt 146, nut means 148, and twin exhaust delivery outlets 150 and 152.

An angular connector 154 has a bore which engages rotary valve cylinder 158 in liquid tight relation and the cylinder 158 turns with the turning of the angular connector 154. Sealing rings 160 provide a liquid seal between the cylinder 158 and the stationary cylindrical part 140. An annular space 162 (FIG. 21) is provided between adjoining end portions of the angular connector 154, cylindrical part 140, and rotary valve cylinder 158 so the frame 130 may be mounted in such angular space 162 with the vertical portion 132 of the frame 130 free for relative sliding movement as respects the rotary valve 158, the cylindrical part 140, and the angular connector 154. The bolt 146 passes through a hole in the cap 144, a hole in the end wall of the valve cylinder 158, and is threaded into a tapped passageway 159 in the angular connector 154.

Figure 19:
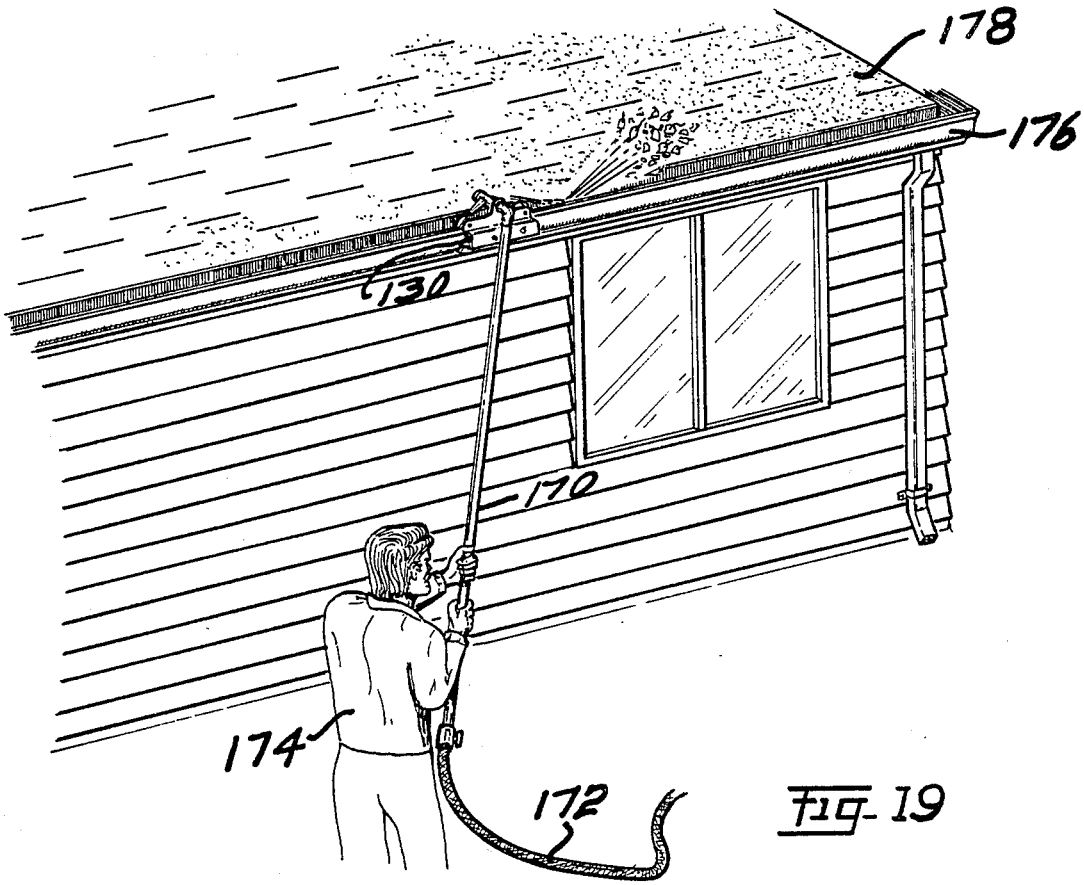
Figure 20:
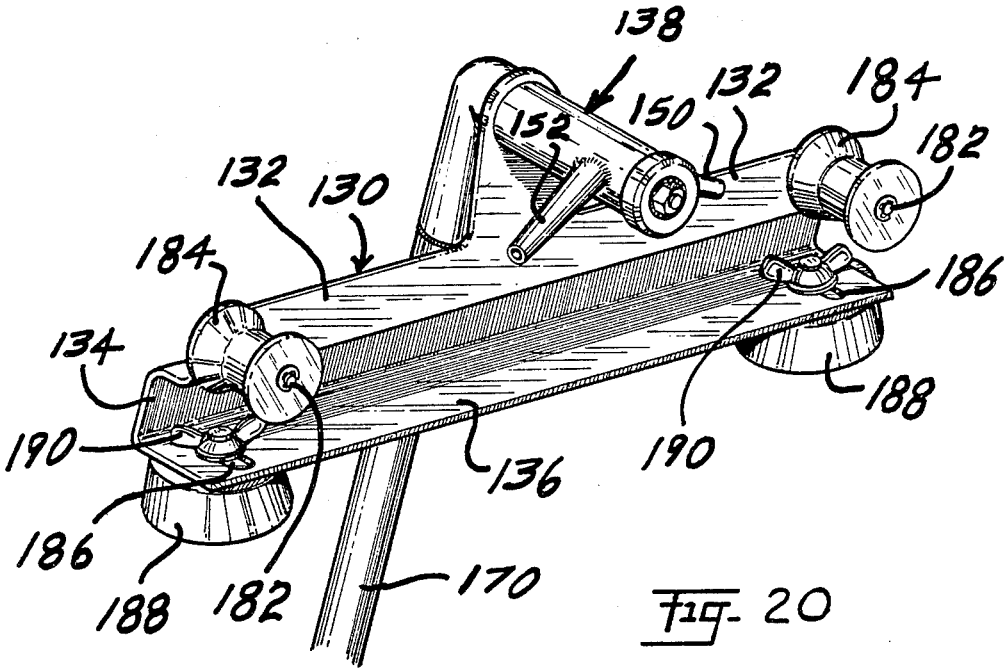
Figure 21:
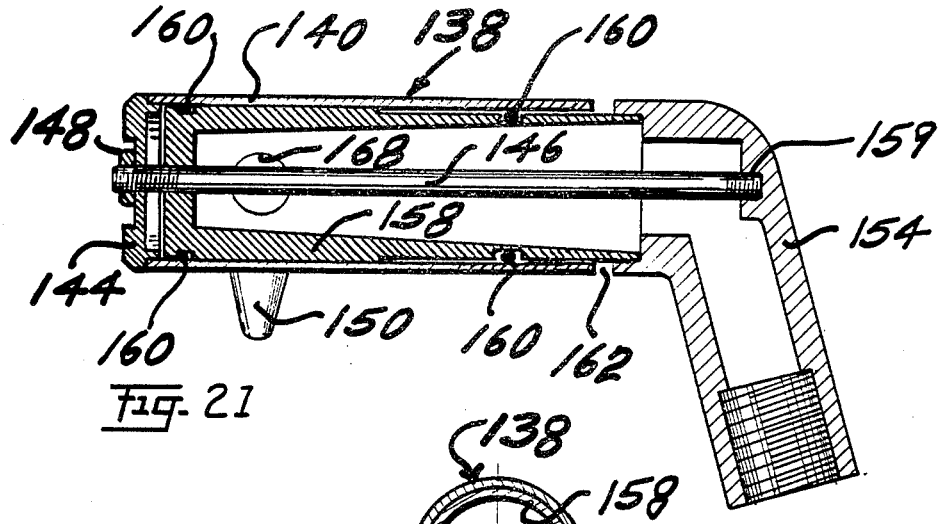
Figure 22:
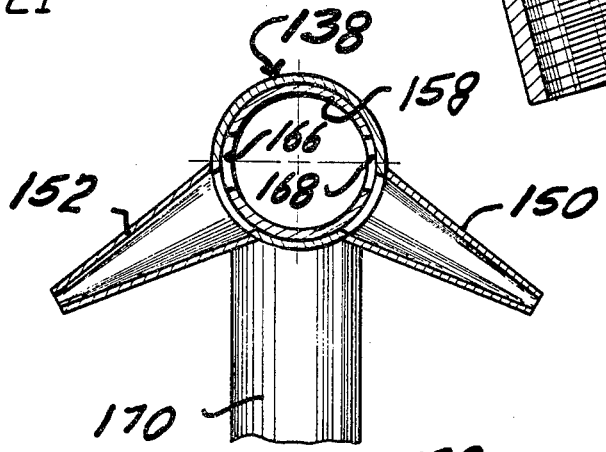
Figure 23:
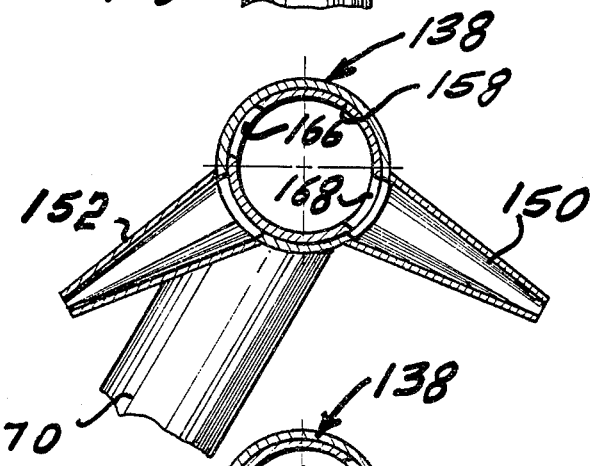
Figure 24:
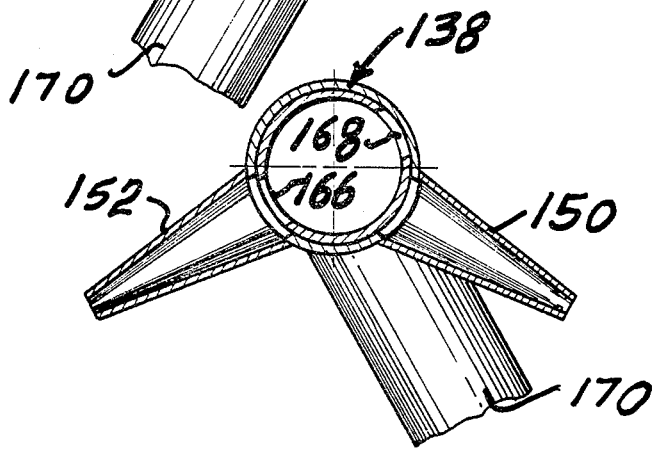
Figure 25:
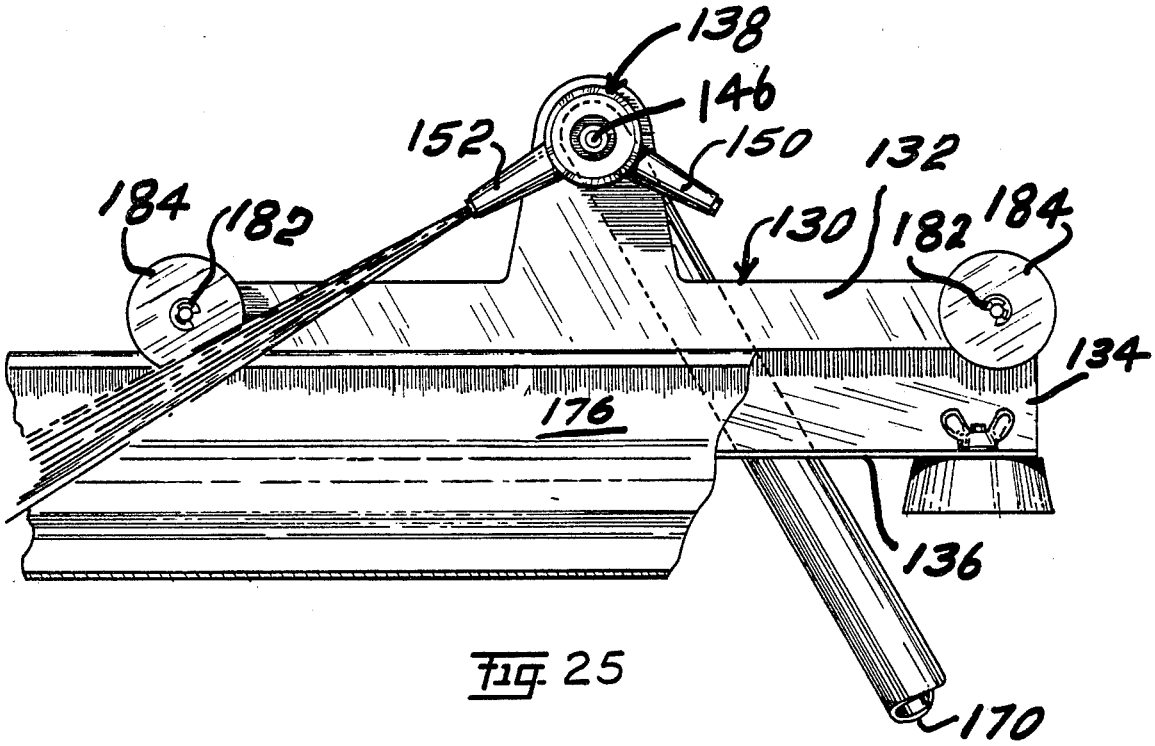
Figure 26:
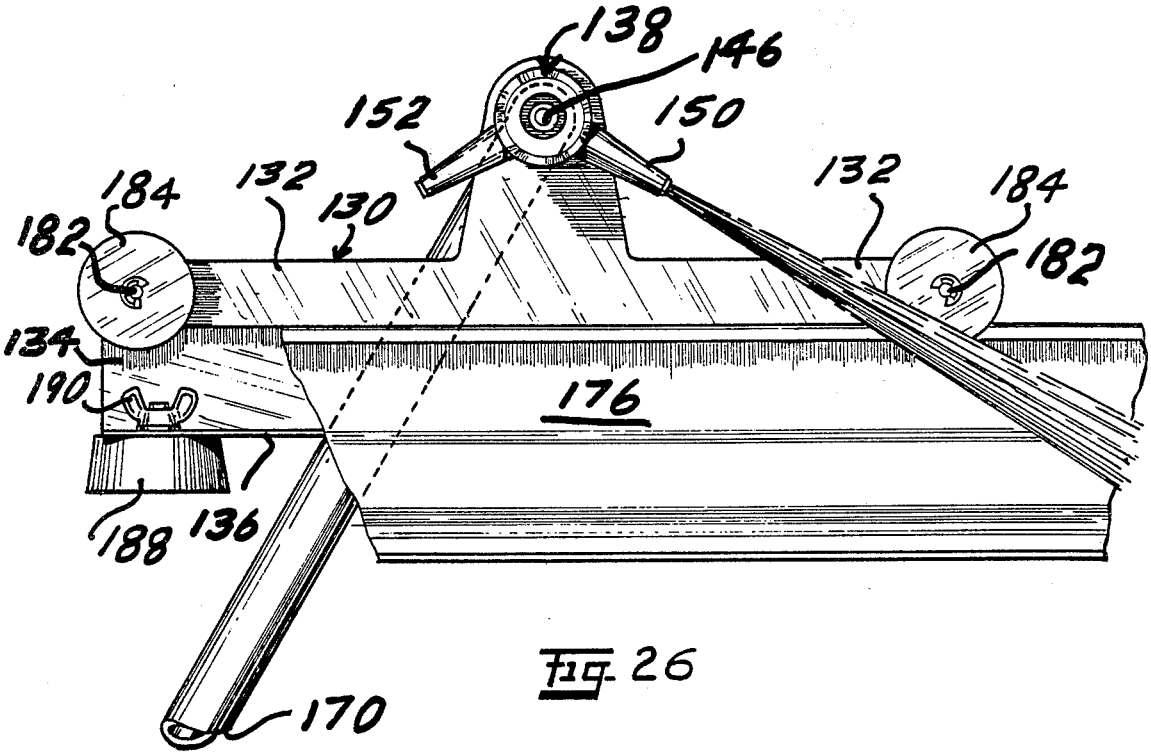

The rotary valve cylinder 158 has two ports 166 and 168 therein so that fluid in the rotary valve cylinder 158 may be discharged through one of said ports. The angular connector 154 is rigid with a rigid conduit 170 which, in turn, is connected by a hose 172 to a source of fluid under pressure. As the conduit 170 is rigid and of the desired length, it may be hand grasped by a person 174 on the ground as is illustrated in FIG. 19. The conduit 170 may be turned to the left (see FIGS. 23 and 26) and the port 168 will register with the exhaust outlet 150 and the fluid under pressure will pass from 172 and 170 through port 168 and out exhaust 150 and into the rain gutter 176 (see FIG. 19) of the house 178. When the conduit 170 is turned to the right (see FIGS. 24 and 25), the port 166 will register with the exhaust outlet 152 and the fluid under pressure will pass from 172 and 170 through port 166 and out exhaust 152 and into the rain gutter 176. The last-mentioned operation is depicted in FIG. 25. Spaced apart stops 180 (see FIGS. 16 and 17) are carried by frame 130 and limit the relative movement between frame 130 and conduit 170 and counter any thrust resulting from fluid discharging out exhaust outlet 150 or 152.

It will be noted that when the rigid conduit 170 is to the left, as in FIG. 19, the person 174 is also to the left and fluid under pressure is being sprayed to the right or away from the person 174. Also, if the conduit 170 is turned to the right, the person will be to the right and again, the sprayed fluid is to the left and away from the person 174.

The hose 172 connects to a source of fluid under pressure. This may be water with an appropriate detergent therein, clean water, or air. Each of such fluids may be useful in cleaning a rain gutter.

The vertical portion 132 of the frame 130 supports horizontally disposed axes 182, each of which, in turn, rotatably mounts support rolls 184. The horizontal portion 136 of the U-shaped portion 134 is provided with slots 186. Guide roll means 188 are provided with wing nuts 190 and by manipulation thereof, the guide rolls 188 may be moved toward and away from vertical portion 132 and secured in place when properly positioned. The support roll means 184 will ride on an outside rail of a rain gutter 176 to support the frame 130 and parts supported therefrom for traveling movement along rain gutter 176 and the guide roll means 188 will prevent the frame 130 and parts carried therefrom from lateral canting as the guide roll means 188 engage with a mid portion of the outside rail of a rain gutter 176.

A fluid, such as water alone, water with a desired detergent or solvent for particular contaminants mixed therewith, or air or combinations thereof is provided under pressure and connected with the hose 172. The fluid selected will depend upon the debris and contaminant in a particular rain gutter in a particular area. In all instances, when the particular rain gutter is reachable by a pole and an operator 174 standing on the ground or on a walkable surface area, the operator 174 will push on the rigid conduit 170 and the exhaust of fluid or material cleaned from a rain gutter 176 will be away from the operator 174 and the fluid will be out either one of the exhausts 150 or 152 depending upon the position of the rigid arm 170.

In one version of the invention there is the gutter cleaner 20 comprising a carriage frame 22 having a top plate 24 and a support flange 26. On the top plate 24 there is a hollow fluid carrier 28. On the carrier 28 there is mounted a high pressure swivel nozzle 30.

Between the support flange 26 and the carriage frame 24 there are four (4) roller spools 36. The roller spools 36 allow the gutter cleaner 20 to move and be guided along the upper outside edge 118 of a gutter 120. On the lower bottom of the carriage frame 22 is an adjustable bottom plate 38 with three (3) guide rollers 40.

The carriage frame 22 with the roller spools 36 and the guide roller 40 make it possible to utilize the invention with a number of different configurations of gutters.

The high pressure nozzle, by means of a fluid passage 52, allows the invention to be connected to a garden hose. The invention can be moved along the gutter and the water or cleaning fluid ejected from the high pressure nozzle 30 can assist in cleaning the gutter. Also, the reaction from the fluid cleaning agent flowing through the high pressure nozzle 30 assists in moving the invention along the gutter.

RESUME

In one version of the invention I have provided a gutter cleaner 20 which comprises a carriage frame 22 having a top plate 24 and a support flange 26. On the top plate 24 there is a hollow fluid carrier 28 carrying a high-pressure swivel nozzle 30. The nozzle 30 is connected to a hollow coupling 32 and an elbow 34. Between the support flange 26 and the carriage frame 22 are four roller spools 36. These spools allow the gutter cleaner 20 to move and be guided along the upper outside edge 118 of a gutter 120. On the bottom of the carriage frame 22 is an adjustable bottom plate 38 with three guide rulers 30.

The gutter cleaner 20 connects with a source of fluid such as a garden hose which connects with a source of water. On the gutter cleaner 20 there is a high-pressure nozzle 30 which connects with a coupling for connecting with a garden hose. There may be used water or water with a cleaning agent such as a detergent or there may be used air for cleaning the gutter.

A person may stand on the ground and move the gutter cleaner 20 along the gutter so as to remove dirt, leaves and debris from the gutter. In this manner a person is not subject to falling from a ladder or falling from the roof of a building having the gutter.

It will now be apparent, that I have provided in another version, a rain gutter cleaning mechanism comprising a frame member 130 comprising a fixed tubular part 138. This fixed tubular part 138 is supported by the vertical portion 132. Preferably, the cylindrical part 140 of the tubular part 138 is spaced from angular connector 154 and the vertical portion 132 of frame 130 is mounted for angular movement in the space 162 between cylindrical part 140, angular connector 154, and rotary valve cylinder 158. The fixed tubular part 138 is provided with two exhaust ports 150 and 152, 150 directing exhaust fluids to the right in a rain gutter 176 and exhaust port 152 directing such fluids to the left. The rotary valve cylinder 158 is mounted for rotary movement in relatively fixed cylindrical part 140. The ports 166 and 168 in cylinder 158 connect the rotary valve cylinder 50 with outlets 152 and 150, respectively, when the rotatable valve cylinder 148 is turned to the right and left, respectively, by the operator 174 manipulating rigid conduit 170. This conduit 170 is connected to a source of fluid pressure by hose 172.

More specifically, the conduit 170 is a rigid member so it functions as a conductor and also as a lever to control the operative position of the valve 138, 140 and the outlet 150, 152 out which fluid will be discharged. This fluid may include water alone, water and a selected detergent or solvent, or air alone, or combinations thereof.

The frame member 130 is preferably formed of a single piece and is metal or a plastic and is provided with portions extending relatively in vertical and horizontal directions, as vertical portion 132 and horizontal portion 136. The vertical portion 132 mounts spaced apart roller means 184 on horizontal axes for mounting the frame 130 and parts connected therewith for traveling movement on a side wall or rail of a rain gutter 176. The horizontal portion 136 of the frame 130 mounts guide rollers 188 on horizontal axes for guiding the frame 130 and parts connected therewith against lateral tipping movement as the frame 130 and parts connected therewith travel on the outer rail or side wall of a rain gutter 176.

The guide rollers 188 are each individually laterally adjustably mounted by use of wing nuts 190 and parts associated therewith to match device to a variety of size and shape rain gutters 176.

By having a rotary valve of parts 138 and 158 and lever handle 170 connected with the relatively moving valve part 158, the fluid discharging from the device may be discharged out a selected discharge nozzle 150 or 152 and in the desired direction, such as away from an operator 174 operating lever handle 170.

Obviously, changes may be made in the forms, dimensions, and arrangement of the parts of my invention without departing from the principle thereof, the above setting forth only preferred froms of embodiment of my invention.

I consider my invention to be new, useful and unobvious. For example, I consider my invention to be new as I do not know of another apparatus for cleaning gutters and which apparatus is the same, or similar, to my invention.

My invention is useful as it can be used for cleaning gutters. This is, particularly so with respect to a gutter which is hard to reach and the person cleaning the gutter may place himself in jeopardy if he gets onto the roof or on a high ladder. My invention can be used for cleaning a gutter which is a number of feet off the ground.

I consider my invention to be unobvious in view of the prior art I know. The prior art I know is the three patents to TYDINGS, WILSON and OLSON. I consider that my invention defines over WILSON in that WILSON uses a wheel 19 to contact the roof to assist in stabilizing his cleaner for gutters. It is to be noted that my invention contacts only the gutter and does not need to have a wheel 19 for not riding on the roof. Further, it is to be noted that in WILSON there is an electric motor for moving the cleaner for gutters. With my invention it it not necessary to have an electric motor as the movement of the carriage frame is a combination of the reaction to the flow of fluid through the nozzle and also to the manual movement of the carriage frame. I consider my invention to distinguish over TYDINGS in that with TYDINGS the nozzles are in the gutter while with my invention the nozzles are above the gutter and not in the gutter. As to the reference OLSON it is to be noted that OLSON does not teach of an apparatus for cleaning a gutter. OLSON teaches of an apparatus for washing dishes. The apparatus of OLSON is stable and does not move. The dishes are placed in the cavity or in the inside of the housing of the dishwasher and water and cleaning agent are sprayed onto the dishes. For the foregoing reasons I consider my invention to be unobvious in view of the patents of TYDINGS, WILSON and OLSON.

From the foregoing and having present my invention what I claim is:

1. A rain gutter cleaning mechanism comprising a frame member movable along a rain gutter; a fixed tubular part of a rotary valve mechanism by said frame member; nozzle means carried by said valve part for directing fluid under pressure into a rain gutter; a rotary valve part of said rotary valve mechanism operatively disposed in said fixed tubular part; and a conduit connected to a source of fluid under pressure connected with said rotary valve part for delivering fluid under pressure to said rotary valve mechanism, selectively through said valve mechanism, out said nozzle means, and into the rain gutter.

2. The combination of claim 1, wherein said conduit is a rigid member, depends from the valve mechanism, and also functions as a handle to control movement of the cleaning mechanism along a rain gutter.

3. The combination of claim 2, wherein said frame member carries spaced apart stops disposed in the path of said handle as it selectively travels in respect to the frame member limiting relative travel between the two.

4. The combination of claim 1, wherein the fluid employed includes water therein.

5. The combination of claim 1, wherein the frame member comprises a vertical portion and a plurality of frame supporting spaced roller means carried by the vertical portion and mounting the frame member for travling movement on a rain gutter.

6. The combination of claim 1, wherein guide rollers, disposed to rotate about vertical axes, are carried by said frame member.

7. The combination of claim 1, wherein the frame member comprises a horizontal portion and guide roller means are carried by said horizontal portion and mount the frame member against crosswise tilting as the frame member travels on a rain gutter.

8. The combination of claim 7, wherein each of said guide spaced rollers is individually adjustable in a lateral direction relative to a rain gutter.

9. The combination of claim 1, wherein said nozzle means comprises two nozzles pointed in opposite directions.

10. The combination of claim 8, wherein the rotary valve mechanism provides alternate open positions to said two nozzles.

11. The combination of claim 10, wherein a relatively stationary valve part is carried by the frame member; a rotary valve part having two spaced discharge ports, each movable alternately into registration with a nozzle means; and lever means connected with said rotary valve means and extending downwardly from the frame member to an operator therebelow.

12. The combination of claim 11, wherein the lever means is a combination lever and entrance conduit connected to a source of fluid under pressure.

13. The combination of claim 11, wherein the frame member is mounted for angular movement on said rotary valve part.

14. The combination of claim 13, wherein said frame member is laterally spaced from and movable relatively in a recess defined by the rotary valve part as the bottom wall thereof, and the side wall of the relatively fixed valve member and side wall of a connector to a source of fluid under pressure as the side walls of said recess.

15. The combination of claim 1, wherein the frame member comprises a vertical portion fixedly secured to the tubular part of the valve mechanism, and a U-shaped depending portion terminating in a horizontal portion; support roller means rotatively mounted on a horizontal axis carried by said vertical portion; and a guide roller means rotatively mounted on a vertical axis carried by said horizontal portion.

* * * * *